United States Patent [19]

Rhoads

[11] Patent Number: 4,550,824

[45] Date of Patent: Nov. 5, 1985

[54] BOTTLE CARRIER

[75] Inventor: Roger R. Rhoads, Toledo, Ohio

[73] Assignee: Owens-Illinois, Inc., Toledo, Ohio

[21] Appl. No.: 667,188

[22] Filed: Nov. 1, 1984

Related U.S. Application Data

[63] Continuation-in-part of Ser. No. 530,566, Sep. 9, 1983, abandoned.

[51] Int. Cl.[4] ..... B65D 71/02; B65D 85/62

[52] U.S. Cl. ..... 206/150; 206/151; 206/158

[58] Field of Search ..... 206/150–159, 206/161, 427; 294/87.2, 87.28

[56] References Cited

U.S. PATENT DOCUMENTS

| | | | |
|---|---|---|---|
| 3,084,792 | 4/1963 | Poupitch | 206/150 |
| 3,721,337 | 3/1973 | Braun et al. | 206/150 |
| 3,784,003 | 1/1974 | Bolton | 206/158 |
| 3,874,502 | 4/1975 | Wearer | 206/158 |
| 4,109,787 | 8/1978 | Klygis et al. | 206/150 |

*Primary Examiner*—William T. Dixson, Jr.
*Assistant Examiner*—Brenda J. Ehrhardt
*Attorney, Agent, or Firm*—Philip M. Rice

[57] ABSTRACT

A bottle carrier for carrying a plurality of bottles having a body portion and a neck portion and a closure which is crimped around the neck of the bottle and forms a concave fillet at the juncture with the container comprising a generally flat blank formed of a material that is flexible and elastic and has a central portion with a plurality of openings for receiving the neck of the containers and engaging the containers at the juncture of the closure fillet and the container. The carrier also includes a peripheral band that is severable from the first part and moved about the periphery of the bottles. Each opening has a configuration of a substantially isometric 36° ellipse, the ratio of the length of major axis to the length of the minor axis being between 0.5 and 0.65, and the ratio of the perimeter of the greatest side wall dimension of the closure to the perimeter of the opening ranging between 1.25 and 1.40.

15 Claims, 4 Drawing Figures

BOTTLE CARRIER

This application is a continuation-in-part of application Ser. No. 530,566 filed Sept. 9, 1983, now abandoned.

This invention relates to bottle carriers and particularly bottle carriers for carrying a plurality of bottles having narrow necks with closures crimped over the necks.

BACKGROUND AND SUMMARY OF THE INVENTION

It has hereto been proposed that carriers for cans and bottles be made of a sheet of flexible and elastic material having a plurality of openings through which the upper ends of the cans or necks of the bottles extend and are held to provide a pack of cans or bottles.

In the making of such carriers for bottles having narrow necks such as conventionally used for soft drinks and beer, it is necessary that the bottles be secured in the carrier so that they can be readily handled and at the same time they can be easily removed without excessive force.

Various configurations of openings have heretofore been suggested as shown, for example, in U.S. Pat. No. 4,109,787.

Such a carrier has been extensively used in connection with cans. However, the use of such carriers for bottles having narrow necks such as conventionally used for soft drinks and beer has not been extensive because the bottles must be secured in the carrier so that they can be readily handled and at the same time can be easily removed without excess force.

In the handling of bottles, the carrier that has been proposed is such as shown in U.S. Pat. No. 4,084,792 wherein the sheet of flexible elastic material comprises an inner part having the opening through which the upper ends of the necks extend and a peripheral band that is severable from the first part and moved about the periphery of the group of bottles to form and complete the package. As far as is known, such a carrier for bottles had not been successfully used.

The problem of securing the containers in the carrier and making the carrier such that the bottles can be readily removed is also dependent on the nature of the closure applied to the bottles. Where the closure is crimped on the neck of the bottle, such as an aluminum roll-on closure wherein the closure forms a concave radius or fillet at the juncture with the container, the problem is even more complex.

Among the objectives of the present invention are to provide a carrier which comprises a generally flat blank and has openings of a specific configuration such that bottles with crimped closures will be securely held and yet be easily removed from the carrier.

In accordance with the invention, the neck receiving openings in the carrier have a configuration of a substantially isometric 36° ellipse, the ratio of the length of the major axis to the length of the minor axis being between 0.5 and 0.65 and preferably about 0.57 and the ratio of the perimeter of the greatest side wall dimension of the closure to the perimeter of the opening ranging between 1.25 and 1.40, being 1.35 to 1.40 for heavy filled bottles and 1.25 to 1.30 for lighter filled bottles.

DESCRIPTION

Figure 1:
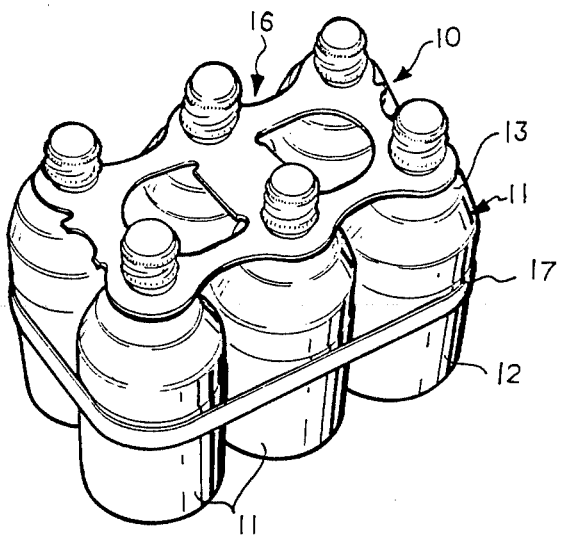
FIG. 1 is a perspective view of a carrier pack of a carrier embodying the invention on bottles with crimped closures.
Figure 4:
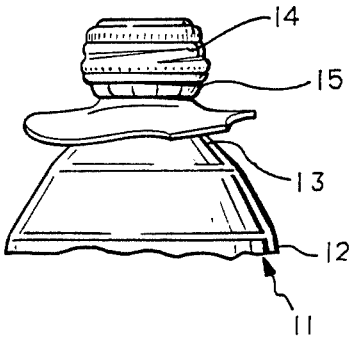
FIG. 4 is a fragmentary side elevational view of a portion of a carrier with a bottle in the carrier.

Referring to FIG. 1, the carrier 10 is shown as applied to the containers which comprise bottles 11 having a body portion 12 and a neck 13 with a crimped closure 14 forming a fillet 15 at the juncture of the closure to the bottle 11 (FIG. 4).

Figure 2:
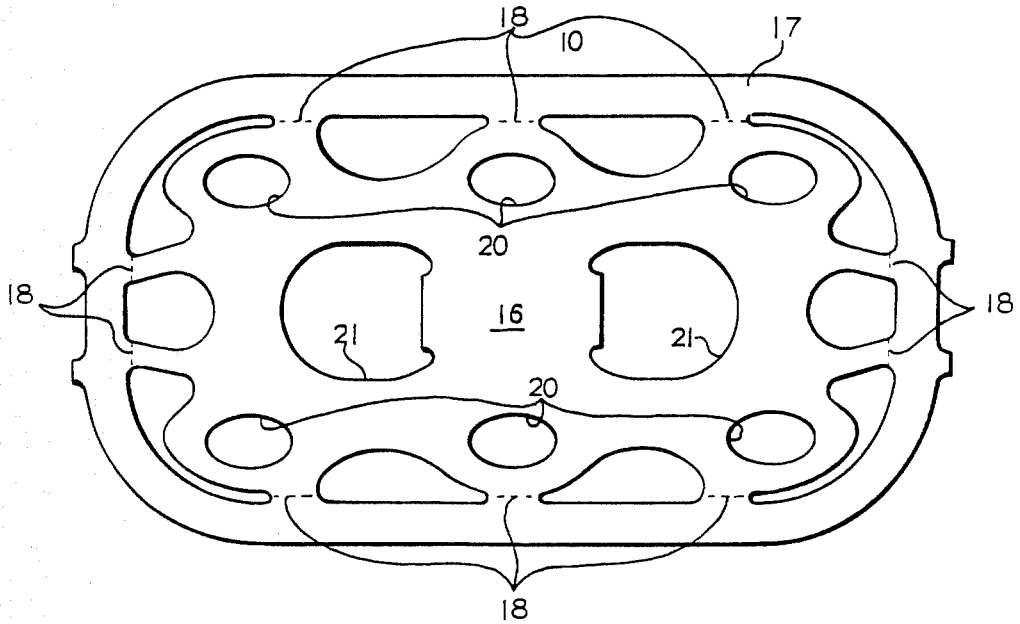
FIG. 2 is a plan view of the carrier.

Referring to FIG. 2, the carrier 10 comprises a flat blank of flexible and elastic material such as low density polyethylene and includes a central portion 16 and a band 17 connected to the central portion along broken or weakened lines 18 such that the band can be stretched and broken away from the central portion 16 during application of the carrier so that the band will surround the bodies of the bottles as shown in FIG. 1.

The carrier further includes a plurality of bottle receiving openings 20 and finger openings 21 for carrying the pack.

Figure 3:
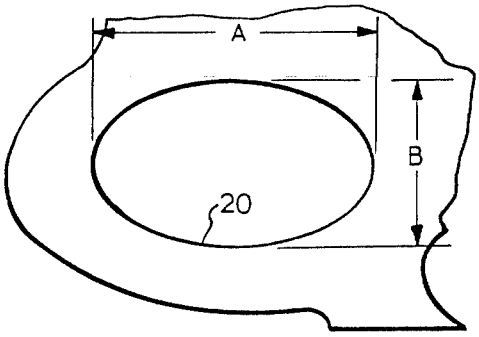
FIG. 3 is a fragmentary enlarged view of one of the bottle receiving openings of the carrier.

In accordance with the invention as shown in FIG. 3, each opening 20 comprises a substantially isometric ellipse, preferably a 36° 40′ ellipse, which has a major axis A and a minor axis B. As shown in FIG. 2, the major axis extends longitudinally of the carrier.

When the carrier is applied to the group of containers, the periphery of each opening 20 is flexed upwardly and contacts the fillet 15 of each bottle as shown in FIG. 4. When it is desired to remove the bottle, it is pulled downwardly causing the periphery of the opening to be flexed downwardly so that the bottle can be readily removed without excessive force.

In accordance with the invention, it has been found that the carrier will effectively retain bottles with crimped-on closures and yet permit the bottles to be readily removed if the openings have the following relationships:

1. The ratio of the length of the major axis to the length of the minor axis being between 0.5 and 0.65 and preferably about 0.57.

2. The ratio of the perimeter of the largest size wall dimension of the closure received in the opening of the perimeter of the opening being 1.35 to 1.40 where heavy filled bottles are to be carried and 1.25 to 1.30 where lighter filled bottles are to be carried.

Tests have shown that where the ratio of major to minor diameter is less than 0.5, the opening tends to tear along the major axis during cyclic drop testing. Where the ratio is greater than about 0.65, the openings fail to hold the bottles during cyclic drop testing.

Drop testing has shown that in order to be effective at both room temperature and elevated temperature, the ratio of the major diameter to minor diameter should preferably be about 0.57.

Prior consumer testing of carriers for bottles has revealed that many women feel that the bottle removal force is too high when it is above 11 pounds.

Tests have shown that with openings in the ratio of the perimeter of the largest side wall dimension of the closure to the perimeter of the openings between 1.35 to 1.40, permitting a minimum stretch of 35 to 40 percent over the closure, the bottle removal force is less than 11 pounds. Where a lighter weight bottle is used, a ratio of 1.25 to 1.30 can be used.

The tests were conducted utilizing an 18 mil sheet for 10 ounce glass bottles (16 oz. filled weight) and a 22 mil sheet for 16 ounce glass bottles (24 oz. filled weight) with crimped aluminum closures.

I claim:

1. A bottle carrier for carrying a plurality of bottles having a body portion and a neck portion and a closure which is crimped around the neck of the bottle and forms a concave fillet at the juncture with the container which comprises a generally flat blank formed of a material that is flexible and elastic, said blank having a central portion with a plurality of openings for receiving the neck of the containers and engaging the containers at the juncture of the closure fillet and the container and a peripheral band that is severable from the first part and moved about the periphery of the bottles, each said opening having a configuration of a substantially isometric 36° ellipse, the ratio of the major axis to the minor axis being between 0.5 and 0.65 and the ratio of the perimeter of the greatest side wall dimension of the closure to the perimeter of the opening ranging between 1.25 and 1.40.

2. The carrier set forth in claim 1 wherein the ratio of the perimeter of the largest side wall dimension of the closure to the perimeter of the opening is 0.35 to 0.40.

3. The carrier set forth in claim 1 wherein the ratio of the perimeter of the largest side wall dimension of the closure to the perimeter of the opening is 1.25 to 1.30.

4. The carrier set forth in claims 1 or 2 wherein said carrier is made of low density polyethylene.

5. The carrier set forth in claim 1 wherein said ratio of the major axis to the minor axis is about 0.57.

6. A bottle carrier for carrying a plurality of bottles having a body portion and a neck portion and a closure which is crimped around the neck of the bottle and forms a concave fillet at the juncture with the container which comprises a generally flat blank formed of a material that is flexible and elastic, said blank having a central portion with a plurality of openings for receiving the neck of the containers and engaging the containers at the juncture of the closure fillet and the container, each said opening having a configuration of a substantially isometric 36° ellipse, the ratio of the major axis to minor axis being between 0.5 and 0.65, and the ratio of the perimeter of the greatest side wall dimension of the closure to the perimeter of the opening ranging between 1.25 and 1.40.

7. The carrier set forth in claim 6 wherein the ratio of the perimeter of the largest side wall dimension of the closure to the perimeter of the opening is 1.35 to 1.40.

8. The carrier set forth in claim 6 wherein the ratio of the perimeter of the largest side wall dimension of the closure to the perimeter of the opening is 1.25 to 1.30.

9. The carrier set forth in claim 6 wherein the ratio of the major axis to the minor axis is about 0.57.

10. A bottle package comprising a plurality of bottles having a body portion and a neck portion and a closure which is crimped around the neck of the bottle and forms a concave fillet at the juncture with the container, a carrier comprising a generally flat blank formed of a material that is flexible and elastic, said blank having a central portion with a plurality of openings receiving the neck of the containers and engaging the containers at the juncture of the closure fillet and the container, each said opening having a configuration of a substantially isometric 36° ellipse, the ratio of the major axis to the minor axis being between 0.5 and 0.65 and the ratio of the perimeter of the greatest side wall dimension of the closure to the perimeter of the opening ranging between 1.25 and 1.40.

11. The bottle package set forth in claim 10 wherein the ratio of the perimeter of the largest side wall dimension of the closure to the perimeter of the opening is 0.35 to 0.40.

12. The bottle package set forth in claim 10 wherein the ratio of the perimeter of the largest side wall dimension of the closure to the perimeter of the opening is 1.25 to 1.30.

13. The bottle package set forth in claim 10 wherein said carrier is made of low density polyethylene.

14. The bottle package set forth in claim 10 wherein the ratio of the major axis to the minor axis is about 0.57.

15. The bottle package set forth in claim 10 including a peripheral band that is severed from the first part and extends about the periphery of the bottles.

* * * * *